US005758778A

United States Patent [19]

Kershner

[11] Patent Number: 5,758,778

[45] Date of Patent: Jun. 2, 1998

[54] GRAIN SEPARATOR

[76] Inventor: Robert Kershner, 1305 Bell Shoals Rd., Brandon, Fla. 33511

[21] Appl. No.: 769,161

[22] Filed: Dec. 19, 1996

Related U.S. Application Data

[63] Continuation of Ser. No. 366,616, Dec. 30, 1994, Pat. No. 5,597,076.

[51] Int. Cl.[6] ..... B07B 9/00

[52] U.S. Cl. ..... 209/29; 209/283; 209/386; 209/390; 209/616

[58] Field of Search ..... 209/28, 29, 138, 209/139.1, 281, 283, 300, 379, 385, 386, 389, 390, 615, 616, 683; 15/3.11, 305

[56] References Cited

U.S. PATENT DOCUMENTS

| | | | |
|---|---|---|---|
| 142,705 | 9/1873 | LaCroix | 208/386 X |
| 306,329 | 10/1884 | Fiechter | 209/386 |
| 402,012 | 4/1889 | Freeman | 209/386 X |
| 3,587,858 | 6/1971 | Christianson | 209/390 X |
| 5,348,161 | 9/1994 | Mueller | 209/29 |
| 5,597,076 | 1/1997 | Kershner | 209/29 |

FOREIGN PATENT DOCUMENTS

| | | | |
|---|---|---|---|
| 5246572 | 4/1977 | Japan | 209/390 |

*Primary Examiner*—William E. Terrell
*Assistant Examiner*—Tuan N. Nguyen
*Attorney, Agent, or Firm*—Arthur W. Fisher, III

[57] ABSTRACT

A grain separator to separate and remove contaminants such as dust and debris from grain including an intermediate separator housing having a grain inlet port to receive grain to be scoured from an external source, a grain outlet port to feed scoured grain to an external collector, a first containments discharge port to discharge heavier contaminants removed from the grain to a first external receptacle and a second contaminants discharge port to discharge lighter contaminants removed from the grain to a second external receptacle, a mechanical separator and transport assembly operatively disposed within the intermediate separator housing to receive the grain and contaminants from the grain inlet port to separate the contaminants from the grain and to move the grain from the grain inlet port to the grain outlet port for collection in the external collector, a first containments transport assembly disposed to receive the heavier contaminants from the mechanical separator and transport assembly and to move the heavier contaminants to the first containments discharge port for collection in the first external receptacle and a second containments transport assembly disposed to receive the lighter contaminants from the mechanical separator and transport assembly and to move the lighter contaminants to the second containments discharge port for collection in the second external receptacle.

35 Claims, 4 Drawing Sheets

GRAIN SEPARATOR

CO-PENDING APPLICATION

This application is a continuation application of application Ser. No. 08/366,616, filed Dec. 30, 1994 now U.S. Pat. No. 5,597,076.

BACKGROUND OF THE INVENTION

1. Field of the Invention

A grain separator including a mechanical separator and transport assembly to separate and remove foreign matter such as dust and debris from grain.

2. Description of the Prior Art

Numerous devices have been developed to separate various contaminants from grain.

U.S. Pat. No. 4,208,274 describes a rotary cylinder separator comprising a slightly tiltable, horizontally installed rotary cylinder, a plurality of combs secured to the inside of the cylinder, in parallel and substantially axially of the cylinder, a feeder for introducing a mixture of grainy material and impurities into the cylinder at one end, an outlet formed at the other end of the cylinder for discharging the grainy material out of the cylinder, and a discharge device for discharging the impurities larger in size than the grainy material and that have been scooped by the combs to a high level and have then fallen within the cylinder. The discharge device comprises a fan for producing an air blast within the cylinder, or a combination of a stationary collection trough inserted axially through the cylinder for receiving the impurities that fall from the high level, and a screw conveyor mounted inside the trough.

U.S. Pat. No. 1,710,380 shows a grain separator including a moving separator surface comprising a plurality of pockets or indentations configured to receive predetermined sized material for delivery to a suitable receiving means. Material too large to enter the pockets is collected from the separator and delivered to a discharge opening. The separating capacity and efficiency is increased by a series of deflector blades disposed to receive the coarse refuse material swept from the surface of the separator and advanced from one deflector to another toward the discharging opening.

U.S. Ser. No. 155,874 teaches a seed separator comprising a belt around a cylinder causing the perforations to retain the cockle and carry it up and throw it onto a descending shaking trough hanging in the cylinder, a revolving brush, arranged over the top of the cylinder, forces any grain that may stick in the perforations out into the shaking trough and a brush on one side of the trough keeps the wheat from being carried up and thrown onto the trough.

U.S. Pat. No. 2,991,882 describes a shrimp and fish separating machine comprising a supporting frame, an inclined gauge plate carried by the frame, a cylindrical brush composed of bristles with clipped edges rotatably supported in the frame with the clipped edges of its bristles in relation to the plate to form a trough therewith through which passes a mixture of shrimp and fish, and means for rotating the brush in a direction in which the bristles confronting the plate move upwardly to comb through the feelers of the shrimp and become interdigitated therewith to carry the shrimp upwardly over the brush to the side opposite the plate where the shrimp are free to fall from the brush, the fish in the trough being rotated, and means including the inclined gauge plate and brush to move the fish downwardly to a discharge point at the end of the trough.

SUMMARY OF THE INVENTION

The present invention relates to a grain separator to separate and remove contaminants such as dust, dirt, rodent hairs, insect eggs, small weed seeds and chaff from various types of grain such as wheat, sorghum, whole corn, cracked corn and polished rice.

The grain separator comprises a grain separator housing including an intermediate separator enclosure or housing to operatively have a mechanical separator and transport assembly, a lower contaminants enclosure to operatively house a first contaminants transport assembly disposed to receive heavier contaminants from the intermediate separator housing and an upper contaminants enclosure operatively coupled to a second contaminants transport assembly and disposed to receive lighter contaminants from the intermediate separator enclosure or housing. A drive means including a drive motor is coupled to the mechanical separator and transport assembly and the first contaminants transport assembly through a drive assembly.

The intermediate separator enclosure or housing includes a grain inlet formed on the proximal end thereof to receive grain therethrough, a grain outlet formed on the distal end thereof and an elongated contaminants slot or opening to direct heavier contaminants from the mechanical separator and transport assembly to the first contaminants transport assembly.

The mechanical separator and transport assembly comprises a hollow stationary drum with a plurality of perforations formed therethrough having a rotor operatively supporting a plurality of separator members rotationally disposed therein. A grain feed aperture is formed in the stationary drum beneath the grain inlet to receive unprocessed grain therethrough from the external overhead hopper.

The lower contaminants enclosure, disposed beneath the elongated contaminants slot or opening, includes a first contaminants discharge formed thereon to direct the heavier contaminants from the intermediate separation enclosure or housing to a first external receptacle.

The first contaminants transport assembly comprises a screw conveyor disposed within the lower contaminants enclosure beneath the elongated contaminants slot or opening to receive the heavier contaminants that pass through the perforations as the grain is separated from the contaminants within the mechanical separator and transport assembly by the scraping or scouring action between the separator members and the inner surface of the hollow stationary drum.

The upper contaminants enclosure includes a second contaminants discharge formed thereon in open communication with the mechanical separator and transport assembly to direct lighter contaminants from the intermediate separator enclosure or housing to a second external receptacle through a discharge conduit and the second contaminants transport assembly.

The second contaminants transport assembly comprises an air blower or vacuum with a pair of primary air flow control means formed on intermediate separator enclosure or housing and a secondary air flow control means formed on the grain outlet duct.

To operate the grain separator, the drive motor and air blower or vacuum are connected to an electric power source. Of course, the air blower or vacuum may be mechanically coupled to the drive motor.

In operation, unprocessed grain is gravity fed from an external overhead hopper into the hollow stationary drum through the grain feed aperture where the unprocessed grain engages or is picked up by the rotating separator members scraping or brushing the unprocessed grain against the interior surface of the hollow stationary drum to remove the contaminants from each particle of grain as the grain moves through the intermediate separator enclosure or housing. The helical pattern of the separator member transports the processed grain from the grain feed aperture to the grain outlet. As the contaminants are removed from the grain through the scrubbing or brushing action, the fine heavier particles fall through the perforations where the screw conveyor moves through fine heavier particles to the first contaminants discharge for collection in a first external receptacle. Fine light contaminants are drawn through the perforations through the upper contaminants enclosure by the second contaminants transport assembly controlled by the primary air flow control means. The processed or cleaned grain is discharged from the distal end of the mechanical separator and transport assembly through the grain outlet to an external collector. Larger light contaminants are removed as the processed grain exits the mechanical separator and transport assembly by the second contaminants transport assembly through the upper contaminant enclosure by the second contaminants transport assembly controlled by the secondary air flow control means.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
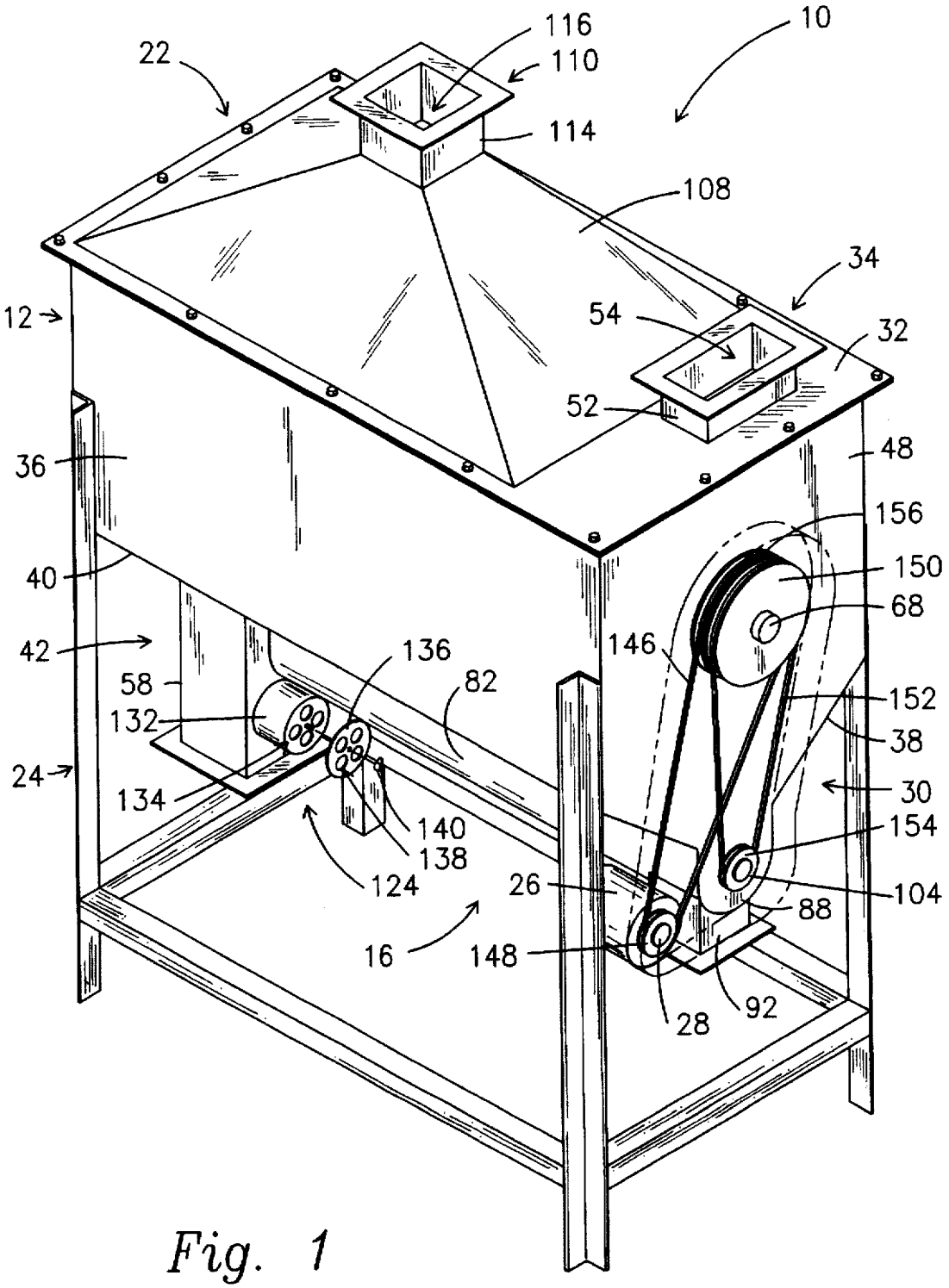
FIG. 1 is a perspective view of the grain separator of the present invention.
Figure 2:
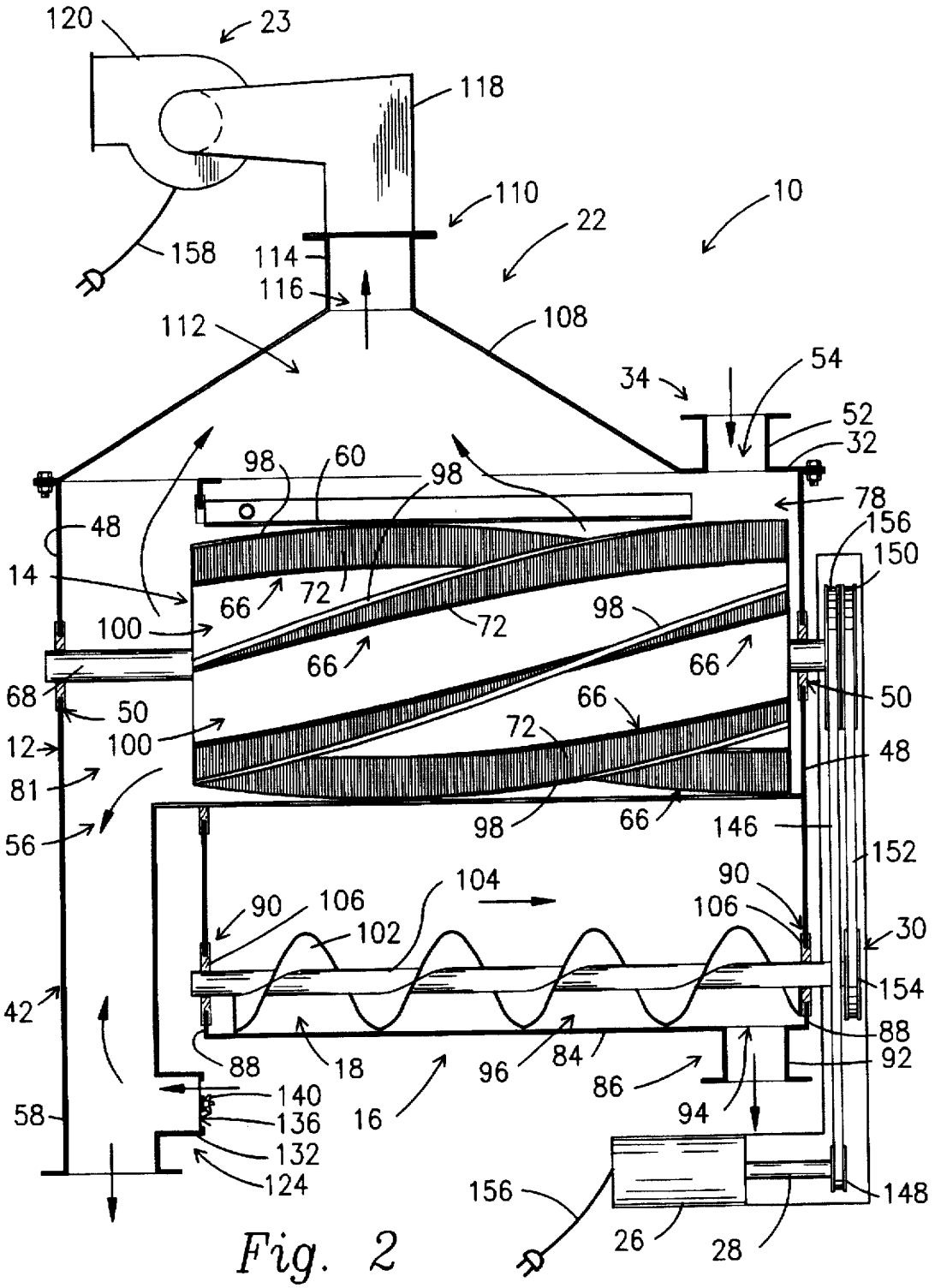
FIG. 2 is a cross-sectional side view of the grain separator of the present invention.
Figure 3:
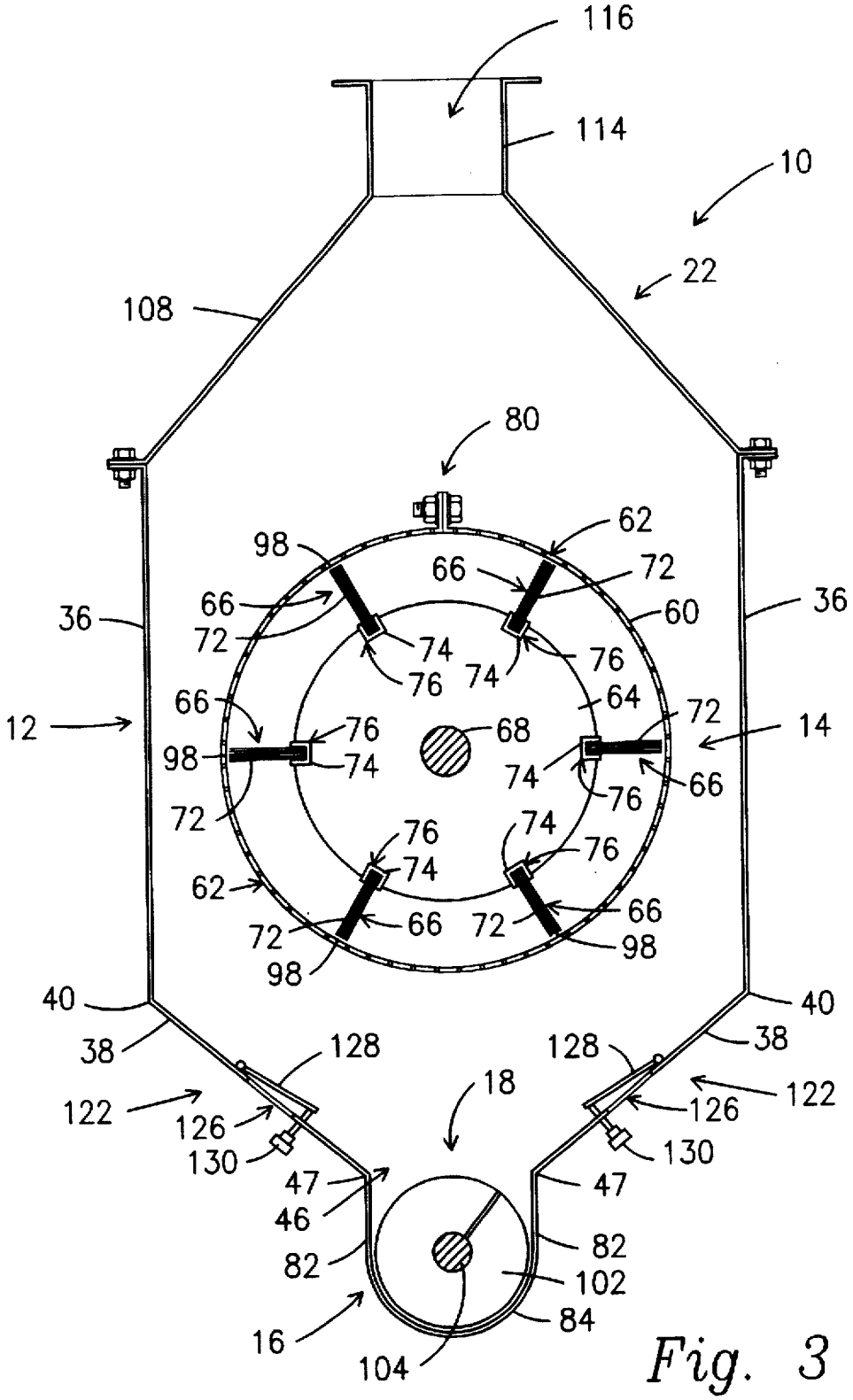
FIG. 3 is a cross-sectional end view of the grain separator of the present invention.

As shown in FIGS. 1 through 3, the present invention relates to a grain separator generally indicated as 10 to separate and remove contaminants such as dust, dirt, rodent hairs, insect eggs, small weed seeds and chaff from various types of grain such as wheat, sorghum, whole corn, cracked corn and polished rice.

As shown in FIGS. 1 through 3, the grain separator 10 comprises a grain separator housing including an intermediate separator enclosure or housing generally indicated as 12 to operatively house a mechanical separator and transport assembly generally indicated as 14, a lower contaminants enclosure generally indicated as 16 to operatively house a first contaminants transport assembly generally indicated as 18 and disposed to receive heavier contaminants from the intermediate separator housing 12 and an upper contaminants enclosure generally indicated as 22 operatively coupled to a second contaminants transport assembly generally indicated as 23 and disposed to receive lighter contaminants from the intermediate separator enclosure or housing 12. The intermediate separator enclosure or housing 12 and the lower contaminants enclosure 16 are supported by a support frame generally indicated as 24 as shown in FIG. 1; while, the upper contaminants enclosure 22 is attached to the upper portion of the intermediate separator enclosure or housing 12. Power to operate the grain separator 10 is provided by a drive means including a drive motor 26 having a drive shaft 28 extending therefrom and coupled to the mechanical separator and transport assembly 14 and the first contaminants transport assembly 18 through a drive assembly generally indicated as 30 as described more fully hereinafter.

As best shown in FIGS. 1 through 3, the intermediate separator enclosure or housing 12 comprises a top wall 32 having a grain inlet generally indicated as 34 formed on the proximal end thereof, a pair of substantially parallel upper side walls each indicated as 36 extending downwardly from the top wall 32, a pair of lower side walls each indicated as 38 inclined inwardly from the lower edge 40 of the corresponding upper side wall 36, a grain outlet generally indicated as 42 formed on the distal end of the intermediate separator housing 12, an elongated contaminants slot or opening 46 cooperatively formed by the lower edges 47 of the inwardly inclined lower side walls 38 to direct heavier contaminants from the mechanical separator and transport assembly 14 to the first contaminants transport assembly 18 and a pair of end walls each indicated as 48 each having an aperture 50 formed therethrough to receive and support a portion of the drive assembly 30 as described more fully hereinafter.

As best shown in FIGS. 1 and 2, the grain inlet 34 comprises a grain inlet duct 52 disposed in surrounding relationship relative to a grain inlet port 54 formed in the top wall 32 to direct unprocessed grain from an external overhead hopper (not shown) to the proximal end of the mechanical separator and transport assembly 14. As best shown in FIG. 2, the grain outlet 42 comprises a grain outlet port 56 formed adjacent the distal end of the mechanical separator and transport assembly 14 having a grain outlet duct 58 disposed in surrounding relationship relative thereto to direct processed grain to an external collector (not shown) for collection.

Figure 4:
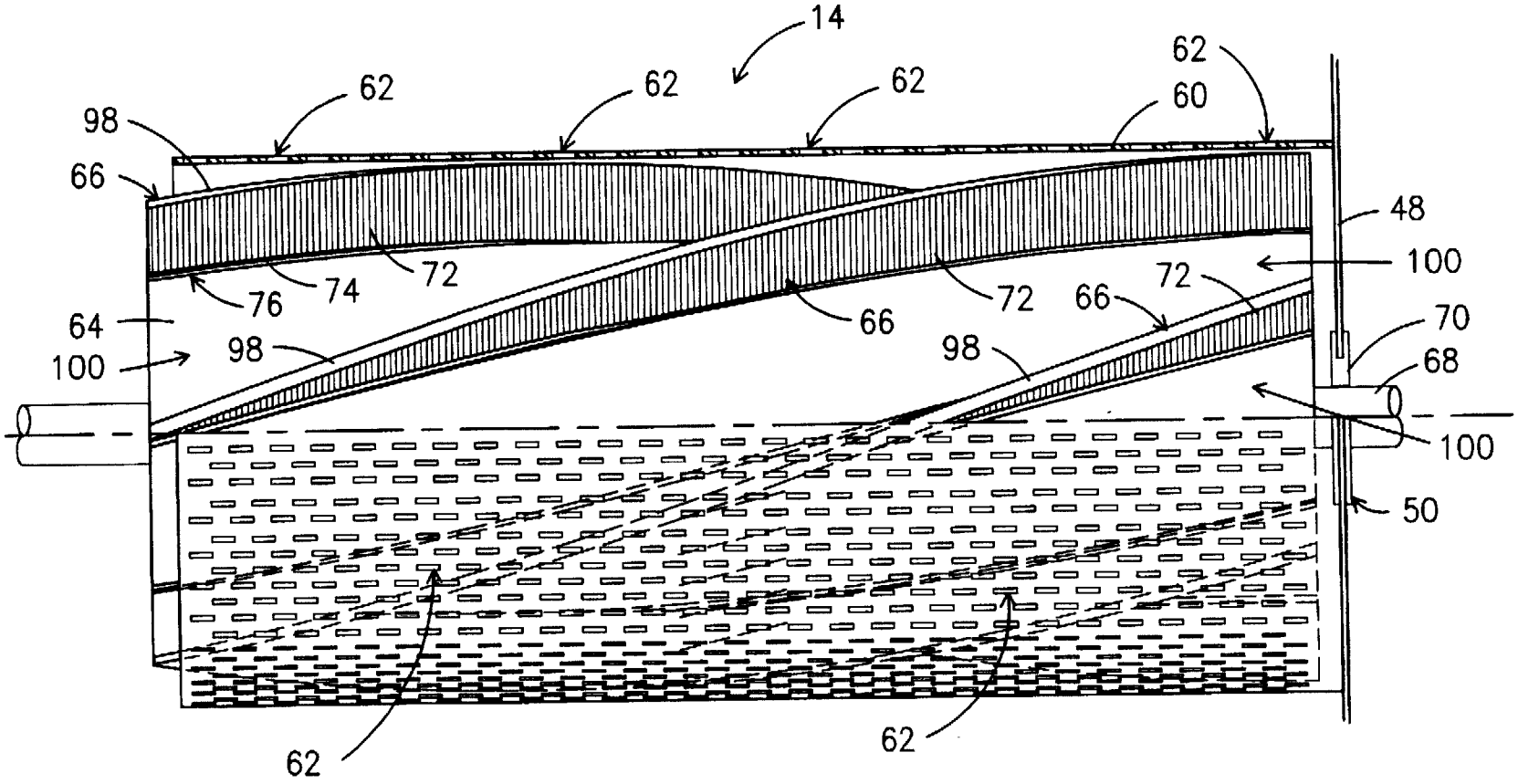
FIG. 4 is a detailed partially cross-sectioned side view of the mechanical separator and transport assembly of the present invention.

As shown in FIGS. 3 and 4, the mechanical separator and transport assembly 14 comprises a substantially cylindrical hollow stationary drum 60 with a plurality of perforations each indicated as 62 formed therethrough having a substantially cylindrical rotor 64 operatively supporting a plurality of separator members each generally indicated as 66 rotationally disposed therein on a separator shaft 68 extending through a bearing 70 operatively mounted within each aperture 50. Each separator member 66 comprises a plurality of flexible metal brush elements each indicated as 72 held together with a retainer element 74 pressed fitted into a corresponding channel 76 formed in the substantially cylindrical rotor 64 to form a 90 degree helical pattern from the proximal end to the distal end of the mechanical separator and transport assembly 14. A grain feed aperture 78 is formed in the hollow stationary drum 60 beneath the grain inlet 34 to receive unprocessed grain therethrough from the external overhead hopper (not shown). The substantially cylindrical hollow stationary drum 60 comprises two halves fastened together by a fastener means 80. The distal end of the mechanical separator and transport assembly 14 is disposed in spaced relationship relative to the distal end wall 48 to cooperatively form a discharge chamber 81.

As best shown in FIGS. 2 and 3, the lower contaminants enclosure 16 comprises a pair of side walls each indicated as 82 extending downwardly from each side of the elongated contaminants slot or opening 46, a lower arcuate bottom 84 extending between the lower edges of the pair of side walls 82 having a first contaminants discharge generally indicated as 86 formed thereon and a pair of end walls each indicated as 88 each having an aperture 90 formed therethrough to receive and support a portion of the drive assembly 30 as described more fully hereinafter. As best shown in FIG. 2, the first contaminants discharge comprises a first contaminants discharge duct 92 disposed in surrounding relationship relative to a first contaminants discharge port 94 to direct the heavier contaminants from the lower contaminants enclosure 16 to a first external receptacle (not shown) as described more fully hereinafter.

As best shown in FIGS. 2 and 3, the first contaminants transport assembly 16 comprises a screw conveyor generally indicated as 96 disposed within the lower contaminants enclosure 16 beneath the elongated contaminants slot or opening 46 to receive the heavier contaminants that pass through the perforations 62 as the grain is separated from the contaminants within the mechanical separator and transport assembly 14 by the scraping or scouring action between the outer ends 98 of the flexible metal brush elements 72 and the inner surface of the substantially cylindrical hollow stationary drum 60. The clearance between the outer ends 98 and stationary drum 60 normally prevents the processed grain from passing between adjacent zones each indicated as 100 formed between adjacent separator members 66. The screw conveyor 96 comprises a continuous helical member 102 extending the length of a screw conveyor shaft 104 operatively mounted between bearings 106 disposed within the apertures 90 formed in the end walls 88.

As best shown in FIGS. 1 and 2, the upper contaminants enclosure 22 comprises a top or cover 108 having a second contaminants discharge generally indicated as 110 formed thereon extending upwardly from the top wall 32 to form a contaminants receiving chamber 112 in open communication with the mechanical separator and transport assembly 14 and discharge chamber 81. The second contaminants discharge 110 comprises a second contaminants discharge duct 114 disposed in surrounding relationship relative to a second contaminants discharge port 116 to direct lighter contaminants from the intermediate separator enclosure housing 12 to a second external receptacle (not shown) through a discharge conduit 118 and the second contaminants transport assembly 23.

As shown in FIGS. 1 through 3, the second contaminants transport assembly 23 comprises an air blower or vacuum 120, a pair of primary air flow control means each generally indicated as 122 formed on the lower side walls 38 of the intermediate separator enclosure or housing 12 and a secondary air flow control means generally indicated as 124 formed on the grain outlet 42. Each primary air flow control means 122 comprises an air flow aperture 126 formed in the inwardly inclined lower side wall 38 beneath the mechanical separator and transport assembly 14 to draw air therethrough when the air blower or vacuum 120 is operating having a flow rate panel 128 movable between an open and closed position hingedly attached to the inclined lower side wall 38 disposed adjacent the air flow aperture 126 to selectively control the volume of air flow therethrough and an adjustable positioning means such as a screw 130 to selectively position the flow rate panel 128 relative to the air flow aperture 126. The secondary air flow control means 124 comprises an air flow control housing 132 having a plurality of air flow apertures each indicated as 134 formed therethrough mounted on the grain outlet 42 of the intermediate separator enclosure or housing 12 and a flow rate plate 136 having a plurality of air flow apertures each indicated as 138 formed therethrough rotatably mounted on the air flow control housing 132 by a connector 140 such that rotation of the flow rate plate 136 relative to the air flow control housing 132 selectively opens and closes the air flow apertures 134 to control the volume of air flowing therethrough.

As best shown in FIGS. 1 and 2, the drive means comprises the drive motor 26 including the drive shaft 28 operatively coupled to the separator shaft 68 by a drive belt or chain 146 connected between a drive sprocket 148 affixed to the drive shaft 28 and a separator drive sprocket 156 affixed to the separator shaft 68. In turn, the screw conveyor shaft 104 is driven by a second drive belt or chain 152 coupled between a lower screw conveyor drive sprocket 154 affixed to the screw conveyor shaft 104 and an upper screw conveyor drive sprocket 150 affixed to the separator shaft 68. When the drive motor 26 is operating the drive belt or chain 146 and the second drive belt or chain 152 respectively will rotate the separator shaft 68 and the screw conveyor shaft 104 in response to the rotation of the drive shaft 28.

To operate the grain separator 10, the drive motor 26 and air blower or vacuum 120 are connected to an electric power source (not shown) through electric conductors 156 and 158 respectively.

In operation, unprocessed grain is gravity fed from an external overhead hopper (not shown) into the substantially cylindrical hollow stationary drum 60 through the grain feed aperture 78 where the unprocessed grain engages or is picked up by the rotating separator members 66 scraping or brushing the unprocessed grain against the interior surface of the substantially cylindrical hollow stationary drum 60 to remove the contaminants from each particle of grain as the grain moves through the intermediate separator enclosure or housing 12. The helical pattern of the separator member 66 transports the processed grain from the grain feed aperture 78 to the grain outlet 42. The size, shape and configuration of the perforations 62 is determined by the type of grain to be processed. As the contaminants are removed from the grain through the scrubbing or brushing action between the outer ends 98 of the flexible metal brush elements 72, the fine heavier particles fall through the perforations 62 where the screw conveyor 96 moves fine heavier particles to the first contaminants discharge 86 for collection in a first external receptacle (not shown). At the same time, fine light contaminants are drawn through the perforations 62 and the upper contaminants enclosure 22 by the second contaminants transport assembly 23 controlled by the primary air flow control means 122 formed on each of the inwardly inclined lower side wall 38. The processed grain is discharged from the distal end of the mechanical separator and transport assembly 14 through the discharge chamber 81 and the grain outlet 42 to an external collector (not shown). Larger light contaminants exiting the mechanical separator and transport assembly 14 are drawn from the contaminants discharge chamber 81 through the upper contaminants enclosure 22 and the second contaminants transport assembly 23 controlled by the secondary air flow control means 124 for collection in a second external receptacle (not shown).

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A grain separator to separate and remove contaminants from grain comprising an intermediate separator housing including a grain inlet to receive grain to be scoured from an external source and a grain outlet to feed scoured grain to an external collector, a lower contaminants enclosure having a first contaminants discharge to discharge heavier contaminants removed from the grain to a first external receptacle, said intermediate separator housing having a mechanical separator and transport assembly disposed therein to receive the grain and contaminants from said grain inlet and to separate the contaminants from the grain and to move the grain from said grain inlet to said grain outlet for collection in the external collector, a first contaminants transport assembly disposed to receive the heavier contaminants from said mechanical separator and transport assembly and to move the heavier contaminants to the first contaminants discharge for collection in the first external receptacle, said mechanical separator and transport assembly comprises a hollow stationary drum including a wall having a plurality of perforations formed therethrough and a rotor rotatably disposed within said hollow stationary drum, said rotor operatively supporting a plurality of separator members, each said separate member including an outer end disposed adjacent said wall, each said separator member comprises an uninterrupted helical configuration extending from the proximal end to the distal end of said hollow stationary drum to cooperatively form grain receiving zones between adjacent separator members to receive a portion of the grain to be scoured therein such that grain received in each said grain receiving zone is retained therein and isolated from adjacent grain receiving zones as the grain is transported from said proximal end to said distal end of said hollow stationary drum.

2. The grain separator of claim 1 wherein said separator member comprises a plurality of flexible brush elements held together with a retainer element pressed fitted into a corresponding channel formed in said rotor.

3. The grain separator of claim 1 wherein said intermediate separator or housing comprises a top wall having said grain inlet formed on the proximal end thereof, a pair of substantially parallel upper side walls extending downwardly from said top wall, a pair of lower side walls inclined inwardly from the lower edge of said corresponding upper side wall, said grain outlet being formed on the distal end of said intermediate separator housing, an elongated contaminants opening cooperatively formed by the lower edges of said inwardly inclined lower side walls to direct heavier contaminants from said mechanical separator and transport assembly to said first contaminants transport assembly and a pair of end walls extending between said top wall, said upper side walls and said lower side walls.

4. The grain separator of claim 1 wherein said first contaminants transport assembly comprises a screw conveyor disposed within said lower contaminants enclosure to receive the heavier contaminants from said mechanical separator and transport assembly as the grain is separated from the contaminants within said mechanical separator and transport assembly.

5. A grain separator to separate and remove contaminants from grain comprising an intermediate separator housing including a grain inlet to receive grain to be scoured from an external source and a grain outlet to feed scoured grain to an external collector, a lower contaminants enclosure having a first contaminants discharge to discharge heavier contaminants removed from the grain to a first external receptacle, said intermediate separator housing having a mechanical separator and transport assembly disposed therein to receive the grain and contaminants from said grain inlet and to separate the contaminants from the grain and to move the grain from said grain inlet to said grain outlet for collection in the external collector, a first contaminants transport assembly disposed to receive the heavier contaminants from said mechanical separator and transport assembly and to -move the heavier contaminants to the first contaminants discharge for collection in the first external receptacle, said mechanical separator and transport assembly comprises a hollow stationary drum having a plurality of perforations formed therethrough and a rotor operatively supporting at least one continuous separator member cooperatively form at least two zones extending substantially the length of said rotor and rotationally disposed within said hollow stationary drum wherein grain fed into each zone is retained in that particular zone when transported through said grain separator and a second contaminants discharge to discharge lighter contaminants removed from the grain to a second external receptacle and a second contaminants transport assembly disposed to receive the lighter contaminants from said mechanical separator and transport assembly and to move the lighter contaminants to the second contaminants discharge for collection in the second external receptacle wherein said second contaminants transport assembly comprises an air blower and at least one primary air flow control means formed on one of said lower side walls of said intermediate separator housing to control the flow of the lighter contaminants from said mechanical separator and transport assembly to said second contaminants discharge.

6. The grain separator of claim 5 wherein said separator member comprises a plurality of flexible brush elements held together with a retainer element pressed fitted into a corresponding channel formed in said rotor.

7. The grain separator of claim 5 wherein each said separator member forms a helical configuration from the proximal end to the distal end of said mechanical separator and transport assembly.

8. The grain separator of claim 5 wherein a grain feed aperture is formed in said hollow stationary drum beneath said grain inlet to feed unprocessed grain from an external source to the interior of said hollow stationary drum.

9. The grain separator of claim 5 wherein said intermediate separator or housing comprises a top wall having said grain inlet formed on the proximal end thereof, a pair of substantially parallel upper side walls extending downwardly from said top wall, a pair of lower side walls inclined inwardly from the lower edge of said corresponding upper side wall, said grain outlet being formed on the distal end of said intermediate separator housing, an elongated contaminants opening cooperatively formed by the lower edges of said inwardly inclined lower side walls to direct heavier contaminants from said mechanical separator and transport assembly to said first contaminants transport assembly and a pair of end walls extending between said top wall, said upper side walls and said lower side walls.

10. The grain separator of claim 9 wherein the distal end of said mechanical separator and transport assembly is disposed in spaced relationship relative to the distal end wall to cooperatively form a discharge chamber in open communication with said grain outlet.

11. The grain separator of claim 10 wherein said grain inlet comprises a grain inlet duct disposed in surrounding relationship relative to a grain inlet port formed in said top wall to direct unprocessed grain from the external source to the proximal end of said mechanical separator and transport assembly and said grain outlet comprises a grain outlet port formed adjacent the distal end of said mechanical separator and transport assembly having a grain outlet duct disposed in surrounding relationship relative thereto to direct processed grain from said discharge chamber to the external collector for collection.

12. The grain separator of claim 5 wherein said first contaminants transport assembly comprises a screw conveyor disposed within said lower contaminants enclosure to receive the heavier contaminants from said mechanical separator and transport assembly as the grain is separated from the contaminants within said mechanical separator and transport assembly.

13. The grain separator of claim 12 wherein said screw conveyor comprises a continuous helical member formed on a screw conveyor shaft.

14. The grain separator of claim 12 wherein said lower contaminants enclosure comprises a side wall extending downwardly from each side of said intermediate separator housing, a lower arcuate bottom extending between the lower edges of said side walls having said first contaminants discharge formed thereon and a pair of end walls.

15. The grain separator of claim 14 wherein said first contaminants discharge comprises a first contaminants discharge duct disposed in surrounding relationship relative to a first contaminants discharge port formed in said lower arcuate bottom.

16. The grain separator of claim 5 wherein said primary air flow control means comprises an air flow aperture formed in said intermediate separator housing beneath said mechanical separator and transport assembly to draw air therebetween and a flow rate panel movable between an open and closed position disposed adjacent said air flow aperture to control the volume of air flow therethrough to draw smaller light contaminants from said hollow stationary drum to said second contaminants for discharge to the second external receptacle.

17. The grain separator of claim 16 further includes an adjustable positioning means to selectively position the flow rate panel relative to said air flow aperture to selectively control the volume of air flow therethrough.

18. The grain separator of claim 17 wherein said second contaminants transport assembly also comprises a secondary air flow control means formed on said intermediate separator housing formed adjacent said discharge chamber to draw larger contaminants expelled from the distal end of said mechanical separator and transport assembly to said second contaminants discharge for discharge to the second external receptacle.

19. The grain separator of claim 18 wherein said secondary air flow control means comprises an air flow control housing having at least one air flow aperture formed therethrough and a flow rate plate having at least one air flow control aperture formed therethrough rotatably mounted on said air flow control housing such that rotation of said flow rate plate relative to said air flow control housing selectively opens and closes said air flow aperture to control the volume of air flowing therethrough.

20. The grain separator of claim 5 including an elongated opening formed between said intermediate separator housing and said lower contaminants enclosure to feed heavier contaminants separated from the processed grain from said intermediate separator housing to said lower contaminants enclosure.

21. A grain separator to separate and remove contaminants from grain comprising an intermediate separator housing including a grain inlet to receive grain to be scoured from an external source and a grain outlet to feed scoured grain to an external collector, a lower contaminants enclosure having a first contaminants discharge to discharge heavier contaminants removed from the grain to a first external receptacle, said intermediate separator housing having a mechanical separator and transport assembly disposed therein to receive the grain and contaminants from said grain inlet and to separate the contaminants from the grain and to move the grain from said grain inlet to said grain outlet for collection in the external collector, a first contaminants transport assembly disposed to receive the heavier contaminants from said mechanical separator and transport assembly and to move the heavier contaminants to the first contaminants discharge for collection in the first external receptacle, said mechanical separator and transport assembly comprises a hollow stationary drum having a plurality of perforations formed therethrough and a rotor operatively supporting a plurality of separator members cooperatively forming zones between adjacent separator members wherein each said separator member forms a helical configuration extending from the proximal end to the distal end of said mechanical separator and transport assembly rotationally disposed within said hollow stationary drum and a second contaminants discharge to discharge lighter contaminants removed from the grain to a second external receptacle and the second contaminants transport assembly disposed to receive the lighter contaminants from said mechanical separator and transport assembly and to move the lighter contaminants to the second contaminants discharge for collection in a second external receptacle wherein said second contaminants transport assembly comprises an air blower and at least one primary air flow control means formed on one of said lower side walls of said intermediate separator housing to control the flow of the lighter contaminants from said mechanical separator and transport assembly to said second contaminants discharge.

22. The grain separator of claim 21 wherein said separator member comprises a plurality of flexible brush elements held together with a retainer element pressed fitted into a corresponding channel formed in said rotor.

23. The grain separator of claim 21 wherein a grain feed aperture is formed in said hollow stationary drum beneath said grain inlet to feed unprocessed grain from an external source to the interior of said hollow stationary drum.

24. The grain separator of claim 21 wherein said intermediate separator or housing comprises a top wall having said grain inlet formed on the proximal end thereof, a pair of substantially parallel upper side walls extending downwardly from said top wall, a pair of lower side walls inclined inwardly from the lower edge of said corresponding upper side wall, said grain outlet being formed on the distal end of said intermediate separator housing, an elongated contaminants opening cooperatively formed by the lower edges of said inwardly inclined lower side walls to direct heavier contaminants from said mechanical separator and transport assembly to said first contaminants transport assembly and a pair of end walls extending between said top wall, said upper side walls and said lower side walls.

25. The grain separator of claim 24 wherein the distal end of said mechanical separator and transport assembly is disposed in spaced relationship relative to the distal end wall to cooperatively form a discharge chamber in open communication with said grain outlet.

26. The grain separator of claim 25 wherein said grain inlet comprises a grain inlet duct disposed in surrounding relationship relative to a grain inlet port formed in said top wall to direct unprocessed grain from the external source to the proximal end of said mechanical separator and transport assembly and said grain outlet comprises a grain outlet port formed adjacent the distal end of said mechanical separator and transport assembly having a grain outlet duct disposed in surrounding relationship relative thereto to direct processed grain from said discharge chamber to the external collector for collection.

27. The grain separator of claim 21 wherein said first contaminants transport assembly comprises a screw conveyor disposed within said lower contaminants enclosure to receive the heavier contaminants from said mechanical separator and transport assembly as the grain is separated from the contaminants within said mechanical separator and transport assembly.

28. The grain separator of claim 27 wherein said screw conveyor comprises a continuous helical member formed on a screw conveyor shaft.

29. The grain separator of claim 27 wherein said lower contaminants enclosure comprises a side wall extending downwardly from each side of said intermediate separator housing, a lower arcuate bottom extending between the lower edges of said side walls having said first contaminants discharge formed thereon and a pair of end walls.

30. The grain separator of claim 29 wherein said first contaminants discharge comprises a first contaminants discharge duct disposed in surrounding relationship relative to a first contaminants discharge port formed in said lower arcuate bottom.

31. The grain separator of claim 21 wherein said primary air flow control means comprises an air flow aperture formed in said intermediate separator housing beneath said mechanical separator and transport assembly to draw air therebetween and a flow rate panel movable between an open and closed position disposed adjacent said air flow aperture to control the volume of air flow therethrough to draw smaller light contaminants from said hollow stationary drum to said second contaminants for discharge to the second external receptacle.

32. The grain separator of claim 31 further includes an adjustable positioning means to selectively position the flow rate panel relative to said air flow aperture to selectively control the volume of air flow therethrough.

33. The grain separator of claim 32 wherein said second contaminants transport assembly also comprises a secondary air flow control means formed on said intermediate separator housing formed adjacent said discharge chamber to draw larger contaminants expelled from the distal end of said mechanical separator and transport assembly to said second contaminants discharge for discharge to the second external receptacle.

34. The grain separator of claim 33 wherein said secondary air flow control means comprises an air flow control housing having at least one air flow aperture formed therethrough and a flow rate plate having at least one air flow control aperture formed therethrough rotatably mounted on said air flow control housing such that rotation of said flow rate plate relative to said air flow control housing selectively opens and closes said air flow aperture to control the volume of air flowing therethrough.

35. The grain separator of claim 21 including an elongated opening formed between said intermediate separator housing and said lower contaminants enclosure to feed heavier contaminants separated from the processed grain from said intermediate separator housing to said lower contaminants enclosure.

* * * * *